US008100295B2

(12) United States Patent
Keller

(10) Patent No.: US 8,100,295 B2
(45) Date of Patent: Jan. 24, 2012

(54) DISPENSING ASSEMBLY WITH REMOVABLY ATTACHABLE ACCESSORIES

(75) Inventor: Wilhelm A. Keller, Merlischachen (CH)

(73) Assignee: Medmix Systems AG, Rotkreuz (CH)

( * ) Notice: Subject to any disclaimer, the term of this patent is extended or adjusted under 35 U.S.C. 154(b) by 465 days.

(21) Appl. No.: 12/224,954

(22) PCT Filed: Mar. 23, 2007

(86) PCT No.: PCT/CH2007/000160

§ 371 (c)(1),
(2), (4) Date: Sep. 10, 2008

(87) PCT Pub. No.: WO2007/109915

PCT Pub. Date: Oct. 4, 2007

(65) Prior Publication Data

US 2010/0163579 A1 Jul. 1, 2010

(30) Foreign Application Priority Data

Mar. 24, 2006 (CH) ..... 453/06

(51) Int. Cl.
*B67D 7/70* (2010.01)

(52) U.S. Cl. ..... 222/137; 222/153.01; 222/145.5; 222/145.6; 222/327; 222/562; 222/567; 604/191

(58) Field of Classification Search ..... 222/145.5, 222/562, 145.6, 546, 145.1, 567, 325–327, 222/153.01, 570, 135–137; 604/191
See application file for complete search history.

(56) References Cited

U.S. PATENT DOCUMENTS

| | | | | |
|---|---|---|---|---|
| 3,767,085 | A | 10/1973 | Cannon et al. | |
| 3,782,600 | A | 1/1974 | Columbus | |
| 4,538,920 | A * | 9/1985 | Drake | 366/181.5 |
| 4,974,756 | A * | 12/1990 | Pearson et al. | 222/562 |
| 4,978,336 | A * | 12/1990 | Capozzi et al. | 604/82 |
| 4,981,241 | A * | 1/1991 | Keller | 222/137 |
| 4,989,758 | A * | 2/1991 | Keller | 222/137 |
| 5,137,182 | A | 8/1992 | Keller | |
| 5,230,422 | A | 7/1993 | Karweik et al. | |
| 5,263,614 | A | 11/1993 | Jacobsen et al. | |
| 5,301,842 | A | 4/1994 | Rutter | |
| 5,333,760 | A * | 8/1994 | Simmen | 222/137 |
| 5,651,397 | A * | 7/1997 | Black et al. | 141/18 |
| 5,875,928 | A | 3/1999 | Müller et al. | |
| 6,161,730 | A | 12/2000 | Heusser et al. | |
| 6,186,363 | B1 | 2/2001 | Keller et al. | |
| 6,398,761 | B1 * | 6/2002 | Bills et al. | 604/191 |

(Continued)

FOREIGN PATENT DOCUMENTS

| | | |
|---|---|---|
| DE | 202 19 529 | 6/2003 |
| DE | 202 19 529 U1 | 6/2003 |
| DE | 203 13 778 | 12/2003 |
| DE | 203 13 778 U1 | 12/2003 |

(Continued)

*Primary Examiner* — Frederick C. Nicolas
(74) *Attorney, Agent, or Firm* — Foley & Lardner LLP

(57) ABSTRACT

A dispensing assembly comprises a syringe and at least one accessory, such as a mixer or a closure cap. The syringe defines a first fastening area with a first pair of retaining elements, and the accessory defines a second fastening area with a second pair of retaining elements. The accessory has a housing with two mutually opposite, compressible housing portions. These housing portions are offset in relation to the second pair of retaining elements along the circumference of the housing. The fastening areas are configured such that the accessory is capable to be slipped-on the syringe and removable therefrom without a twisting motion, by applying pressure to the compressible housing portions.

33 Claims, 9 Drawing Sheets

U.S. PATENT DOCUMENTS

| | | | | |
|---|---|---|---|---|
| 6,769,574 | B1 * | 8/2004 | Keller | 222/137 |
| 7,316,330 | B2 * | 1/2008 | Muller et al. | 222/145.6 |
| 7,556,618 | B2 * | 7/2009 | Sogaro | 604/191 |
| 7,631,782 | B2 * | 12/2009 | Engelbrecht et al. | 222/145.6 |
| 7,694,853 | B2 * | 4/2010 | Keller | 222/137 |
| 2002/0170926 | A1 | 11/2002 | Horner et al. | |
| 2005/0230422 | A1 | 10/2005 | Muller et al. | |

FOREIGN PATENT DOCUMENTS

| | | | |
|---|---|---|---|
| EP | 0 408 331 | | 1/1991 |
| EP | 0 408 331 | A1 | 1/1991 |
| EP | 0 721 805 | | 7/1996 |
| EP | 0 721 805 | A2 | 7/1996 |
| EP | 0 791 403 | | 8/1997 |
| EP | 0 791 403 | A1 | 8/1997 |

* cited by examiner

FIG. 1
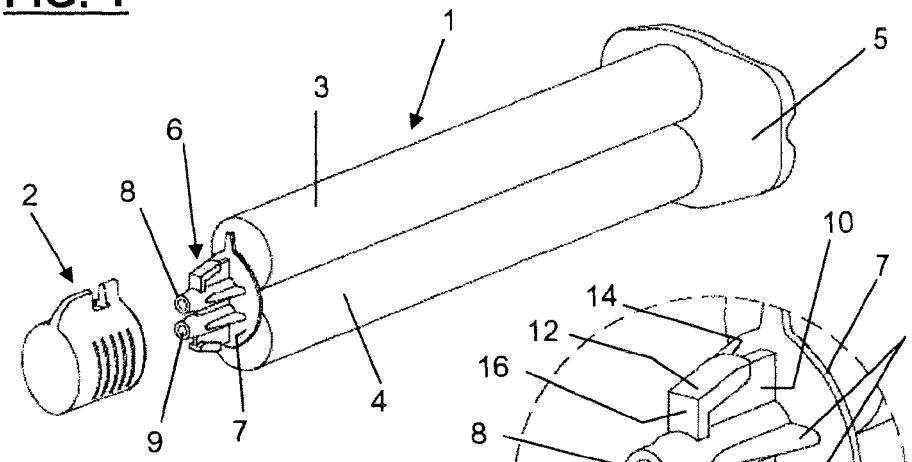
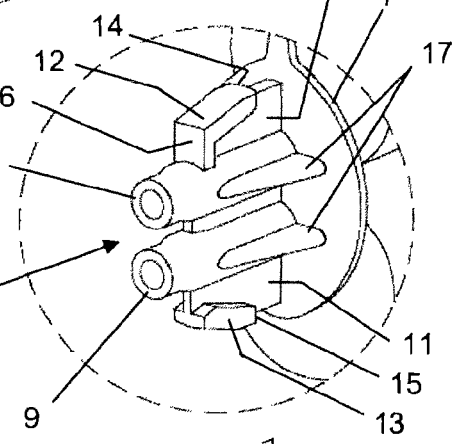
FIG. 2
FIG. 3
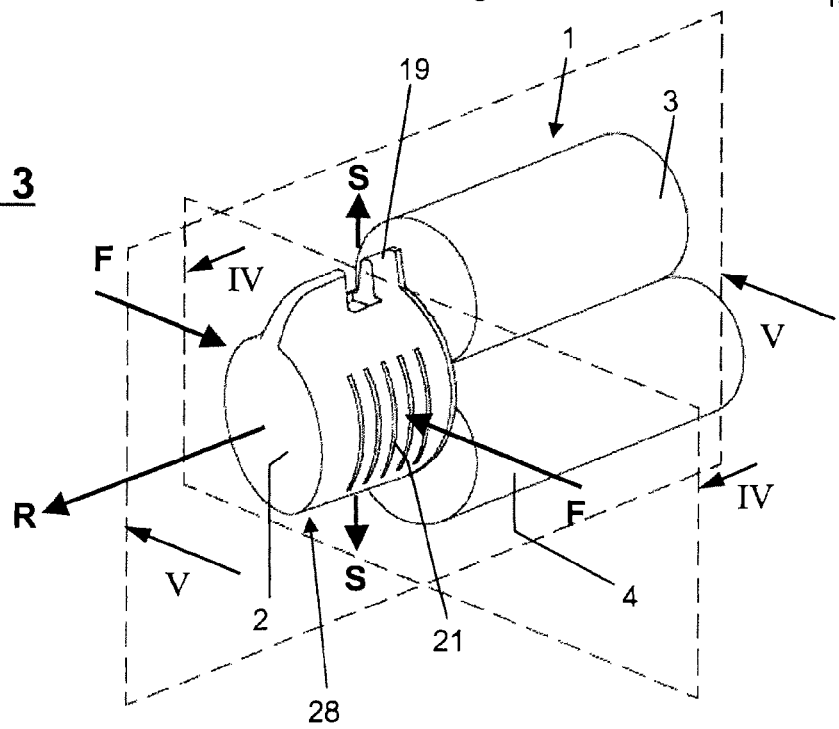

FIG. 7
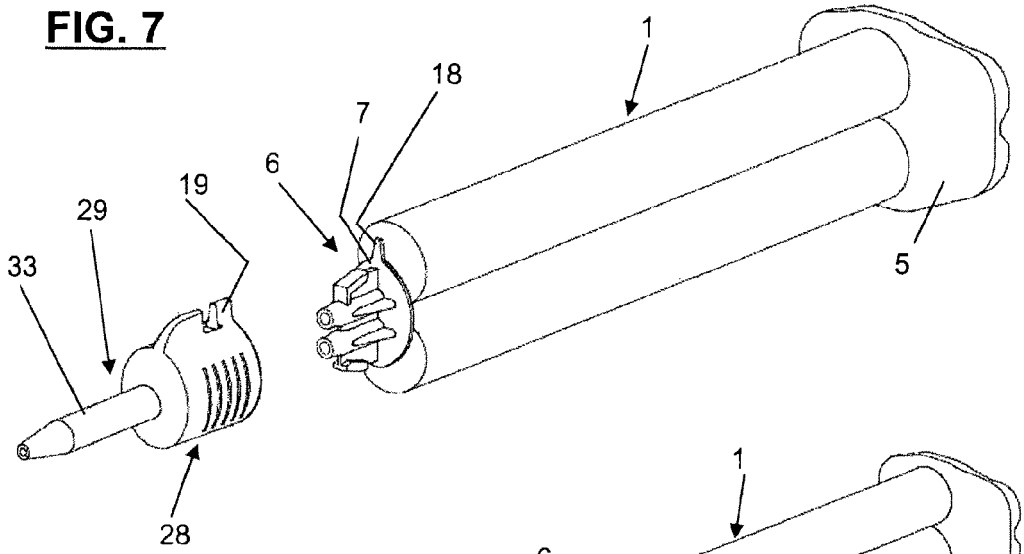
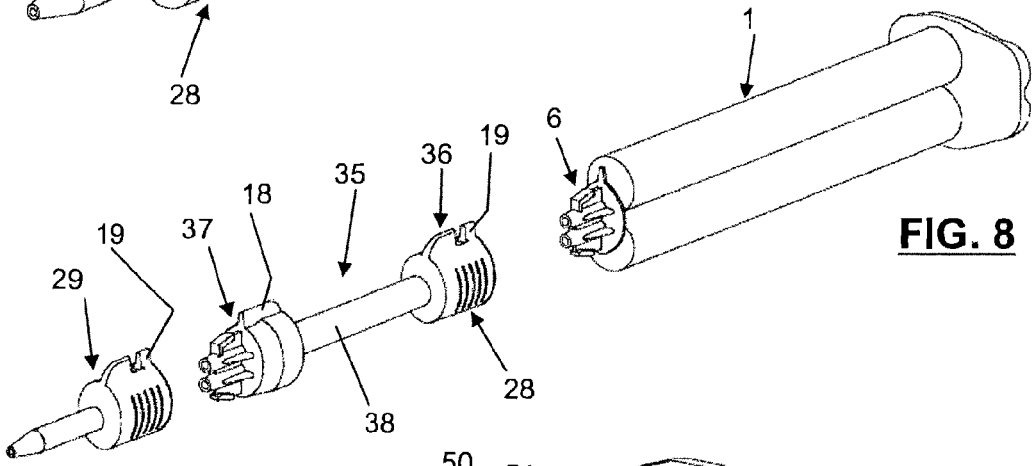
FIG. 8
FIG. 9
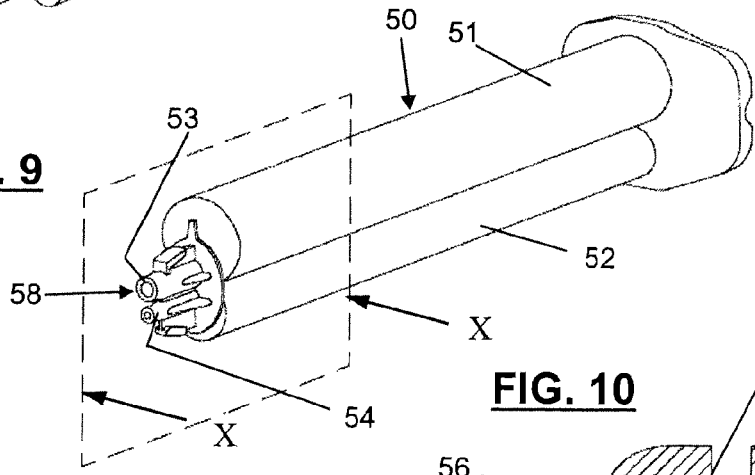
FIG. 10
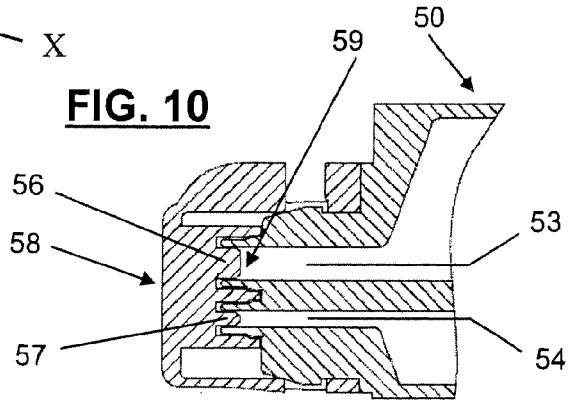

FIG. 15
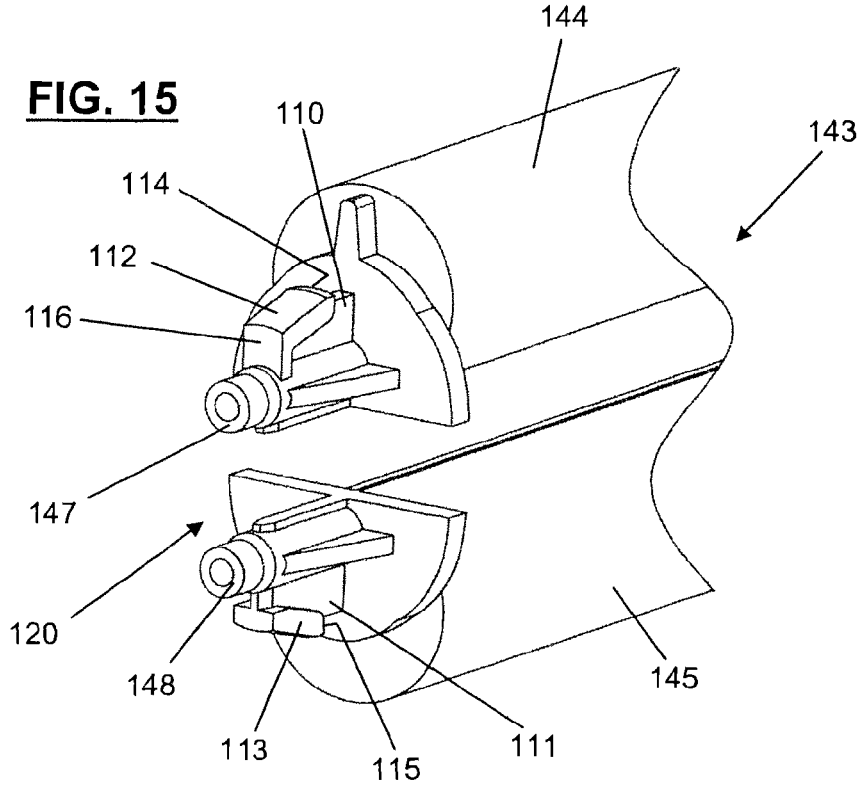
FIG. 16
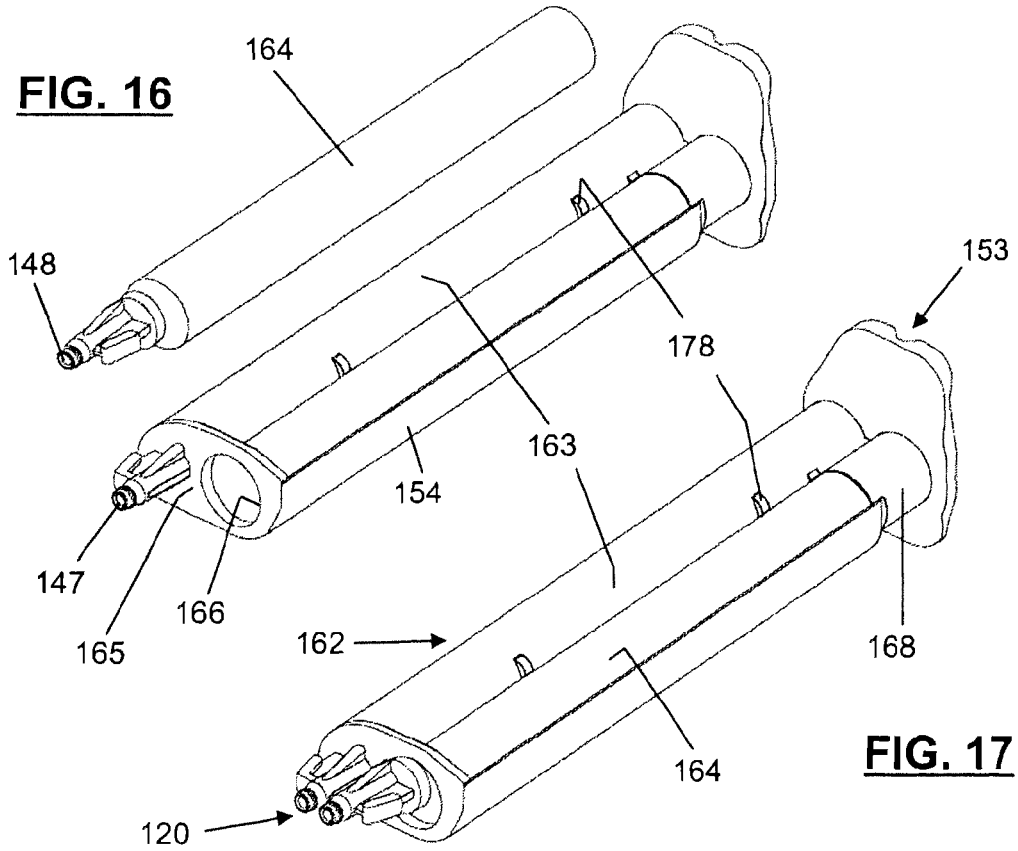
FIG. 17

DISPENSING ASSEMBLY WITH REMOVABLY ATTACHABLE ACCESSORIES

This application is the National Phase of PCT/CH2007/000160, filed Mar. 23, 2007, which claims priority to Switzerland Application No. 00453/06, filed Mar. 24, 2006, the disclosures of which are hereby incorporated by reference in their entirety.

BACKGROUND OF THE INVENTION

The present invention relates to a dispensing assembly including a syringe or cartridge having at least one container and accessories, the fastening area of the syringe or cartridge or of an intermediate part and the fastening area of the accessories being configured such that the accessories are capable to be slipped-on the syringe or cartridge and removable therefrom without a twisting motion by applying pressure to their fastening area and retaining means on one part cooperating with retaining means on the other part.

A large number of syringes, double syringes, cartridges or double cartridges are known in the art to which accessories such as mixers, dispensing tips, spray nozzles, or adapters are connected for dispensing.

Generally, two kinds of fastening means are known in the art, namely fastening members of the bayonet type, on one hand, and fastening members with threaded rings, on the other hand. These fastening means have in common that the fastening members are either relatively demanding to manufacture or an additional part is required and that generally the attachment and removal of the members may be complicated.

Another fastening type according to the preamble of claim 1 is disclosed in US 2005/230422 A1 where the mixer or accessory is snapped onto the cartridge by means of hooks and when the fastening area of the cartridge is compressed, retaining noses arranged therein are disengaged from the hooks on the mixer.

DE 202 19 529 U1 discloses a snap closure where spring arms are provided on the outlet of the cartridge which are caused to lock with an accessory by being deformed. Again, to release the connection, a pressure has to be exerted on the spring arms.

SUMMARY OF THE INVENTION

On this background, it is the object of the present invention to provide a dispensing assembly including a syringe or cartridge having at least one container where the accessories are simple to couple or to remove and whose manufacturing costs are lower than in assemblies of the prior art. This is accomplished by the a dispensing assembly wherein the fastening area of the syringe or cartridge is provided on opposed lateral portions to which pressure is not intended to be applied with at least a first pair of retaining elements that cooperates with a corresponding first pair of retaining elements on the accessories.

Another object of the invention is to allow the containers of the syringes to be separately manufactured and filled and then jointly dispensed while providing the same coupling and uncoupling capabilities. This is accomplished by the a dispensing assembly wherein the double syringe or double cartridge consists of containers that are attached to one another, with associated containers having respective outlets of which at least one is detached and connected to the other container by connecting means, the connecting means comprising a unit consisting of at least a container receptacle a support wall, and a retaining flange, the support wall having at least one recess for receiving at least one of the container outlets and each container receptacle having a guiding sleeve and the outlet side being configured as a fastening area for the attachment of a mixer or accessory.

Another object of the invention is to achieve an increased retention of the accessories on the cartridge while providing the same coupling and uncoupling capabilities. This is accomplished by the a dispensing assembly wherein the fastening area of the cartridge or syringe is provided on opposed lateral portions to which pressure is intended to be applied with a second pair of retaining elements that cooperates with a corresponding second pair of retaining elements on the accessories.

Hereinafter, the term "syringe" is meant to include both a single and a double or multiple syringe or a single, double, or multiple cartridge. Also, double cartridges having concentrically arranged containers or a cylindrical container having a separating wall are encompassed.

BRIEF DESCRIPTION OF THE DRAWINGS

The invention will be explained in more detail hereinafter with reference to drawings of exemplary embodiments.

FIG. 1 shows a perspective view of a first exemplary embodiment of a double syringe according to the invention having a slip-on closure cap, FIG. 2 shows an enlarged detail of the fastening area of the syringe of FIG. 1, FIG. 3 shows the fastening area of the embodiment of FIG. 1 with the closure cap slipped-on thereto and schematically indicated forces that are applied.

FIG. 7 shows a perspective view of the syringe of FIG. 1 with a slipped-on mixer, FIG. 8 shows a perspective view of the double syringe and the mixer of FIG. 7 with an intermediate piece to be slipped-on, FIG. 9 shows a perspective view of an embodiment variant of a double syringe having containers and outlets of different diameters, FIG. 10 shows a section according to line X-X in FIG. 9, FIG. 15 shows a first exemplary embodiment of a two-part cartridge, FIGS. 16 and 17 show a second exemplary embodiment of a two-part cartridge, FIG. 18 shows a double cartridge and mixer in an exploded view, FIG. 19 shows the fastening area of the cartridge of FIG. 18 on an enlarged scale, FIG. 20 shows the fastening area of the mixer, FIG. 21 shows a section in plane XXI-XXI in FIG. 18, FIG. 22 shows a section in plane XXII-XXII in FIG. 18, FIG. 23 shows the cartridge of FIG. 18 with a closure cap, FIG. 24 shows the closure cap of FIG. 23 on an enlarged scale and in a perspective view.

DETAILED DESCRIPTION OF PREFERRED EMBODIMENTS

Figure 4:
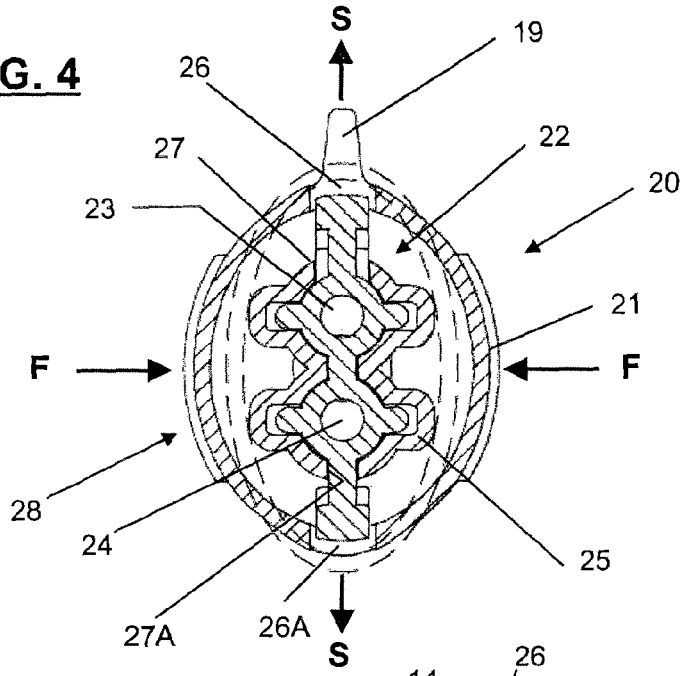
FIG. 4 shows a section according to line IV-IV in FIG. 3.

FIG. 1 shows a syringe 1 and a closure cap 2. Hereinafter, as mentioned before, the term "syringe" is meant to include both a single syringe and a double or multiple syringe as well as a single cartridge or a double or multiple cartridge. The depicted syringes are all double syringes.

Syringe 1 has two containers 3 and 4 and a retaining flange 5. In contrast to the conventional syringes, its fastening area 6 is not provided with bayonet fastening means or screw connections but with snap coupling means which cooperate with corresponding snap coupling means on a respective accessory such as a closure cap, mixer, adapter, spray nozzle or the like accessories.

Fastening area 6 on the outlet side has an outlet flange 7 on which the two individual outlets 8 and 9 are arranged. Each outlet 8 and 9 has an essentially diametrically arranged, outwardly directed ridge 10 respectively 11 that tapers from outlet flange 7 toward the outlet. Each ridge has a respective saddle portion 12, 13 that ends at a distance from the outlet flange, thus forming respective snap noses 14, 15 that snap into snap openings 26, 26A.

The two saddle portions 12 and 13 are not designed alike, saddle portion 12 of this example having an end ridge 16 on its outlet side while saddle portion 13 has none. The presence or absence of end ridge 16 provides a coding means such that the accessory can only be attached in an unequivocal orientation. Furthermore, on both sides of their connecting plane defined by arrows V-V in FIG. 3, the two outlets are provided with clamping guides 17. Additionally, outlet flange 7 has a visual coding nose 18 that serves as an orientation aid for the accessory, the latter having a corresponding orientation nose 19.

FIG. 4 shows closure cap 2 that has an essentially oval fastening area 20, its housing having a corrugation 21 that serves as a finger rest. In its interior, the closure cap has an attachment portion 22 comprising two plugs 23 and 24, see FIG. 5, as well as a clamping portion 25 that is shaped so as to be attachable onto the outlets and clamping guides 17 to exercise a clamping action there.

An essentially oval fastening area, respectively an oval housing portion 28, has proven to be particularly advantageous for its compressibility, but the invention is not limited to this particular shape. The invention is also applicable to a housing portion having a circular or other cross-section.

In the direction of the connecting line between the two outlets, clamping portion 25 has two coding slots 27 and 27A, these coding slots having different widths for receiving either end ridge 16 of saddle portion 12 or saddle ridge 11 that has no end ridge. In other words, the widths of coding slots 27, 27A also constitute coding means that ensure that the cap can only be attached in a single position, thereby preventing any contamination in the case of multiple use.

Figure 5:
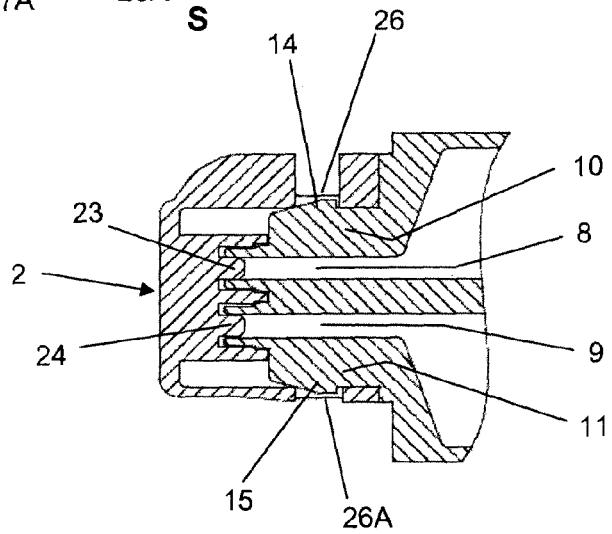
FIG. 5 shows a section according to line V-V in FIG. 3.

Particularly in FIG. 5 it is visible that closure cap 2 has two opposed snap openings 26, 26A at its open end which engage behind snap noses 14 and 15 on the syringe to ensure a firm lock.

FIG. 3 shows the applied forces and FIG. 4 the deformation that occurs when pressure is applied on both sides of fastening area 20 of accessory 2. In this case, as shown in FIG. 4 by chain dotted lines, the housing portion provided with corrugation 21 is compressed and the snap openings designated by arrows S are thereby moved away from the snap noses, thereby releasing the snap noses and allowing the accessory to be withdrawn in the direction R.

Figure 6:
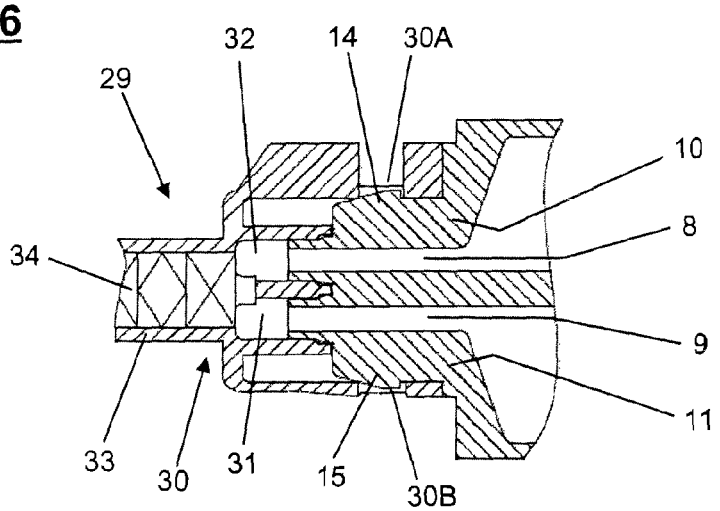
FIG. 6 shows a variant of the embodiment of FIG. 5 with a slipped-on mixer.

In FIGS. 6 and 7, the depicted accessory is a mixer 29 whose fastening area 30 is designed analogously to fastening area 20 of the closure cap, the two separate inlets 31 and 32 being slidable over outlets 8 and 9 of the syringe. The cross-section of mixer fastening area 30 essentially corresponds to the cross-section of fastening area 6 according to FIGS. 4 and 5 of the syringe or closure, respectively, with snap openings 30A and 30B.

In FIG. 8, the depicted accessory is an intermediate piece 35 having a fastening area 36 on the syringe side and a fastening area 37 on the side of the accessory. The two fastening areas are identical to the previously described fastening areas, i.e. the compressible fastening area 36 corresponds to fastening area 30 of the previous example and fastening area 37 corresponds to fastening area 6 of the syringe. Connecting tube 38 may be rigid or flexible and has two channels which carry the two components separately.

In FIGS. 9 and 10, a variant with a double syringe 50 is depicted where the two containers 51 and 52 have different diameters, respectively different volumes of e.g. 4:1. Correspondingly, outlets 53 and 54 also have different diameters while the other parts of fastening area 59 are the same as previously.

It is logical that plugs 56 and 57 of closure cap 58 and inlets 31 and 32 of the mixer correspondingly have different diameters while here also the other parts of fastening area 59 are the same as previously. The different diameters of the outlets and plugs, respectively, and of the mixer inlets provide an additional coding possibility.

In the exemplary embodiments according to FIGS. 1 to 10, a dispensing assembly has been described that is particularly inexpensive to manufacture and easy to handle. However, there may be reasons that make it seem advantageous to use existing syringes e.g. with bayonet couplings.

Figure 11:
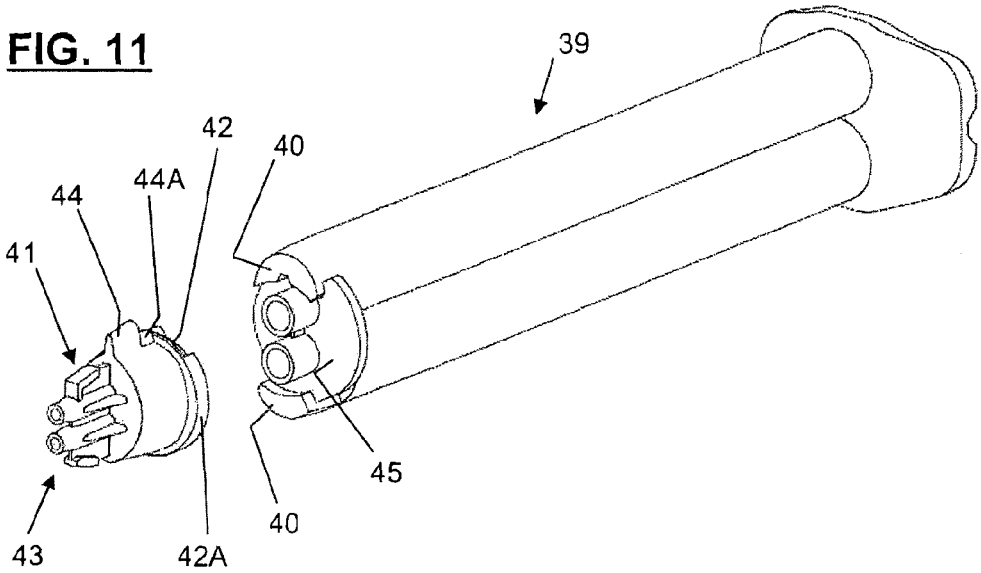
FIG. 11 shows a perspective view of a second exemplary embodiment of the invention with a conventional double syringe and an adapter.

FIGS. 11 to 14 illustrate exemplary embodiments that are based on a conventional syringe having a bayonet coupling. A double syringe 39 of this kind with bayonet slots 40 is shown in FIG. 11. In order to be able to slip-on accessories to such a conventional double syringe, an adapter 41 is required that is connectable to the syringe, on one hand, and has a fastening area as depicted in the preceding examples, on the other hand. To this end, adapter 41 includes bayonet cams 42 and coding segments 42A that may be coded like bayonet slots 40 as it is known in the art. On its other side, the adapter has a fastening area 43 that corresponds to fastening area 6 of the previous example. For the alignment of the attachable accessories, the adapter further comprises an aligning nose 44 as well as a coding nose 44A.

Figure 12:
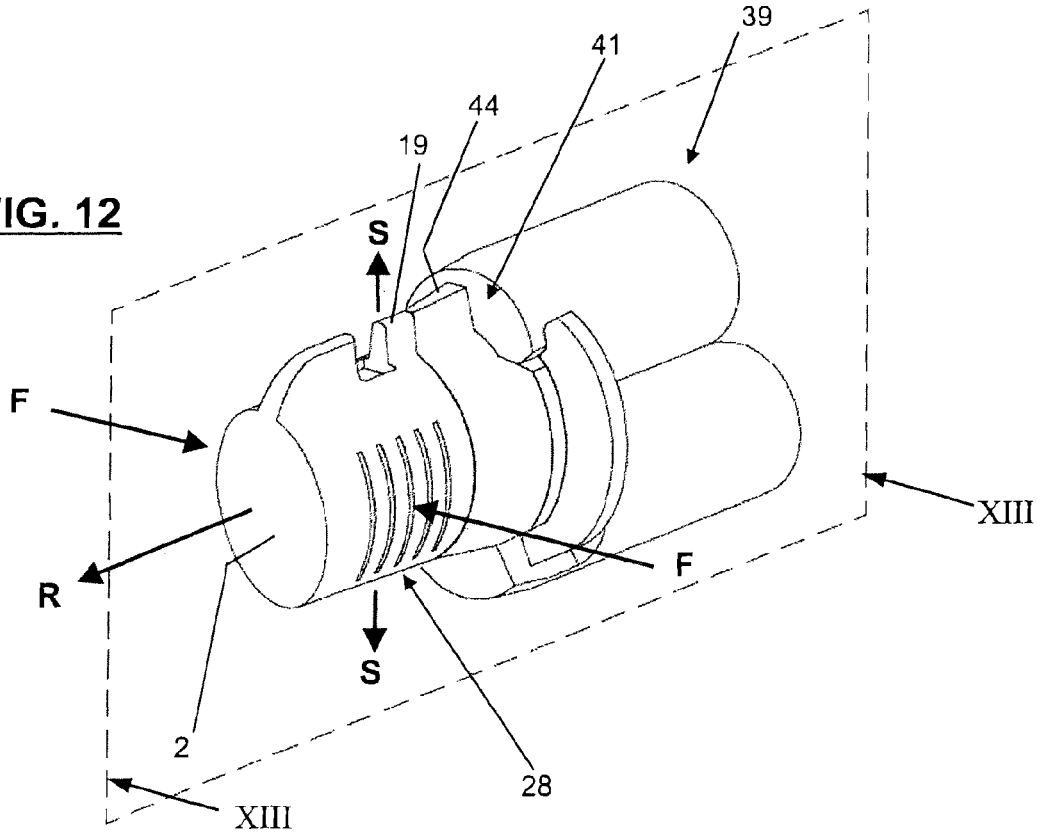
FIG. 12 shows, in analogy to FIG. 3, the fastening area of the syringe of FIG. 11 with the slipped-on closure cap and the course of the applied forces.

In FIG. 12, analogously to FIG. 3, closure cap 2 is slipped-on the double syringe and the adapter. Otherwise, the individual elements are the same as in FIG. 4.

Figure 13:
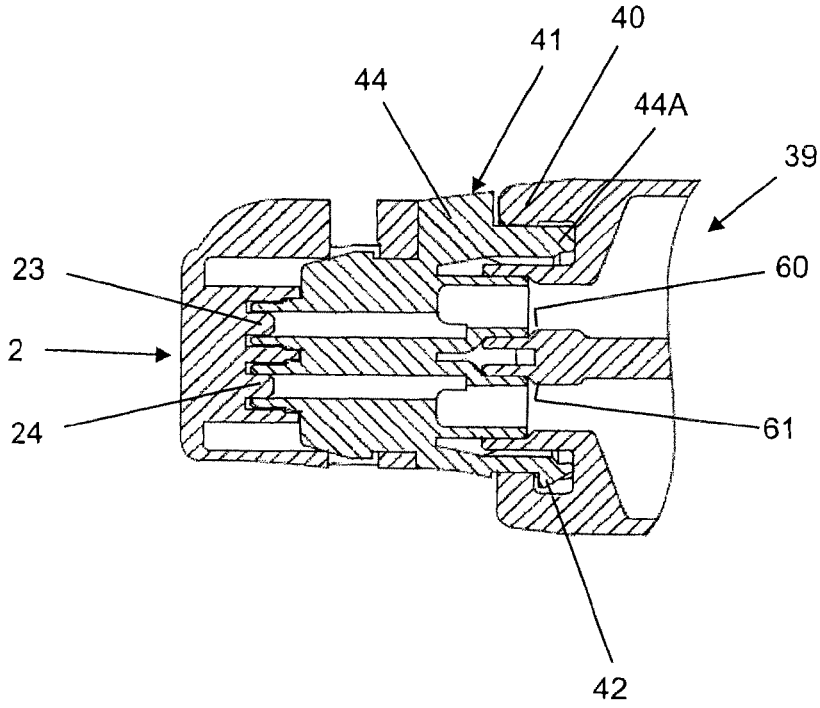
FIG. 13 shows a section according to line XIII-XIII in FIG. 12.

In FIG. 13 it is seen that inlets 48 and 49 of the adapter are pushed into outlets 60 and 61 of the double syringe and bayonet coupling 40 and 42 is engaged.

Figure 14:
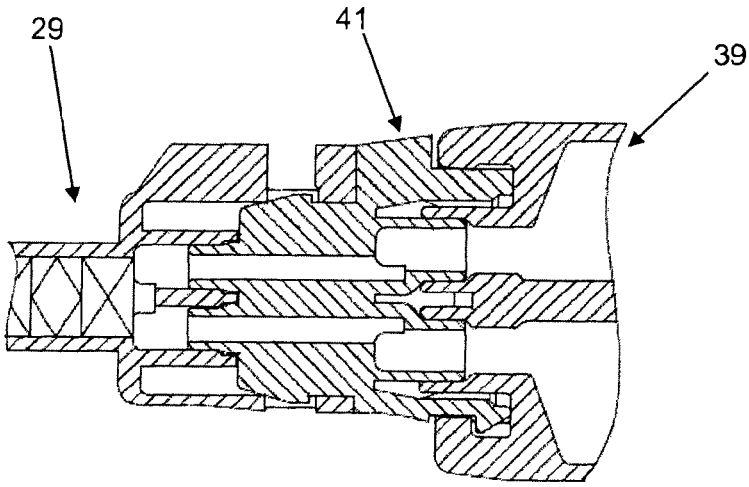
FIG. 14 shows a variant of the embodiment of FIG. 13 with a slipped-on mixer.

In FIG. 14, analogously to FIG. 6, the outlet side of double syringe 39 is shown with the adapter engaged therein and mixer 29 slipped-on thereto. Adapter 41 is identical to the adapter of FIG. 13 while mixer 29 is identical to that of FIG. 6 and is slipped-on and withdrawn in the same manner.

In analogy to the adapter for bayonet couplings, it is also possible to use an adapter for screw connections by means of a coupling nut between the accessory and the syringe. In this case, the adapter has a collar for a coupling nut and the thread is provided on the syringe outlet flange.

The exemplary embodiments according to FIGS. 1 to 14 have in common that the syringe including the at least two containers is made in one piece. This may be a disadvantage for certain two-component materials as the two components may not be compatible with the plastic material of the double syringe or cartridge. Therefore, different requirements apply to the syringe material. Thus, for example, a polypropylene container would be ideal for one component while the other component might require a container of polyamide. Furthermore, in the medical field, there is a need to fill the containers for the two components separately and to subject them to different subsequent treatments, e.g. different sterilization processes, sterile or non-sterile filling procedures.

The second object is attained by providing a two-part syringe, more particularly a double syringe, that is rugged and torsionally rigid and able to receive a large number of conventional accessories without requiring adapter elements. The exemplary embodiments according to FIGS. 15 to 17 meet these requirements.

In the exemplary embodiment according to FIG. 15, double syringe 143 essentially comprises two cylindrical containers 144 and 145 which can be received in a rigid holder with container receptacles that receives the two cylinders on their entire length. Snap means may be provided to retain the cylinders. The two cylindrical containers 144 and 145 have respective outlets 147 and 148 whose diameter is smaller than that of the containers and which are located at the edge of front surfaces 149 and 150 of the containers.

Fastening area 120 of the syringe is designed analogously to the first exemplary embodiments. Each outlet has a respective ridge 110, 111 that tapers from the front surface toward the outlet end. Each ridge has a respective saddle portion 112, 113 that ends at a distance from the front surface, thus forming respective snap noses 114, 115 that snap into snap openings 126, 126A in mixer 129.

As previously, the two saddle portions 112 and 113 are not designed alike, saddle portion 112 of this example having an end ridge 116 on its outlet side while saddle portion 113 has none. Perpendicularly to the plane defined by the ridges, clamping guides 117 are provided. In the case of a coded arrangement, a visual coding nose 118 may be provided on the front surface which cooperates with an orientation nose 119 on the mixer.

The design of syringe 162 according to FIGS. 16 and 17 is similar to that according to FIG. 15, but first container 163 forms a unit together with retaining flange 153 and support wall 165 and container receptacle 154 while second container 164 is the same as container 145. Support wall 165 has a recess 166 for receiving the outlet of second container 163. Container 163 is provided with cams 178 for holding down second container 164. The remaining parts, particularly fastening area 120, are the same as previously described.

Whereas in the exemplary embodiments according to FIGS. 1 to 17, the fastening area is particularly suitable for double syringes, FIGS. 18 to 24 illustrate an exemplary embodiment for a dispensing assembly whose fastening area is designed for a higher retaining force and therefore particularly suitable for cartridges where higher dispensing forces arise.

Figure 18:
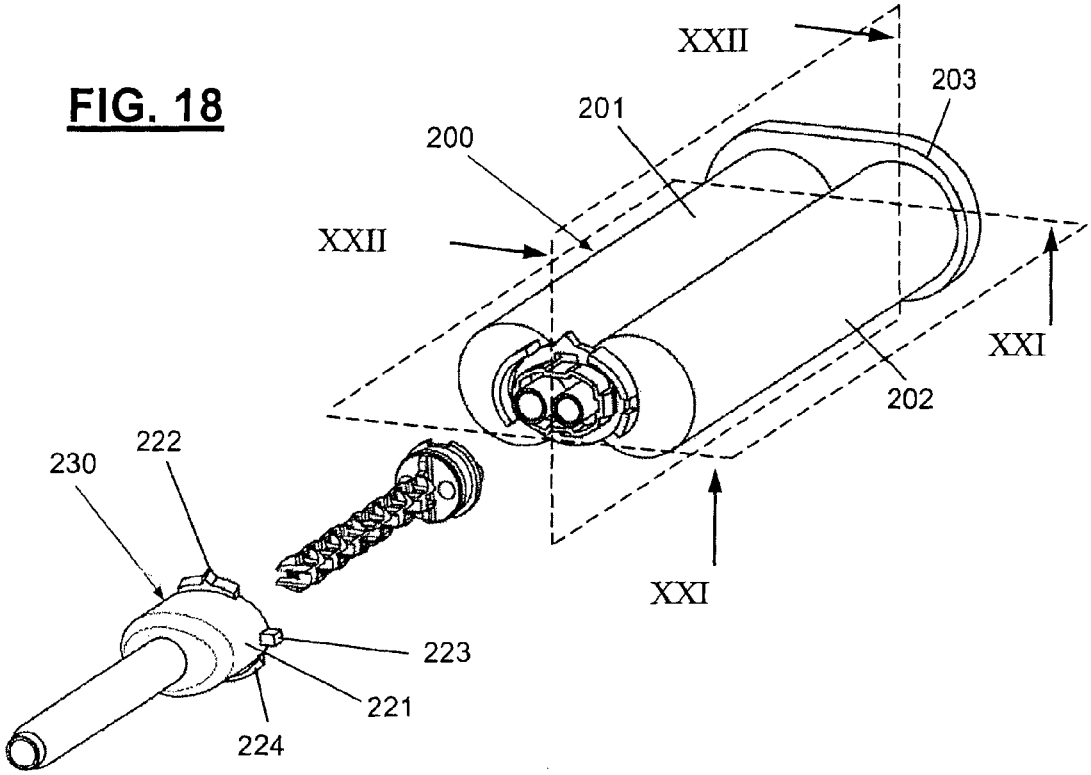
FIGS. 18-24 show an exemplary embodiment of a A A dispensing assembly having an increased retaining force.

FIG. 18 shows an exploded drawing of a double cartridge 200 including the two containers 201 and 202 and an end flange 203 and of a mixer 204 comprising mixer tube 205, mixing helix 204H and mixer inlet portion 204A. Fastening area 220 of the cartridge is well visible in FIG. 19 and fastening area 230 of the mixer in FIG. 20.

Figure 19:
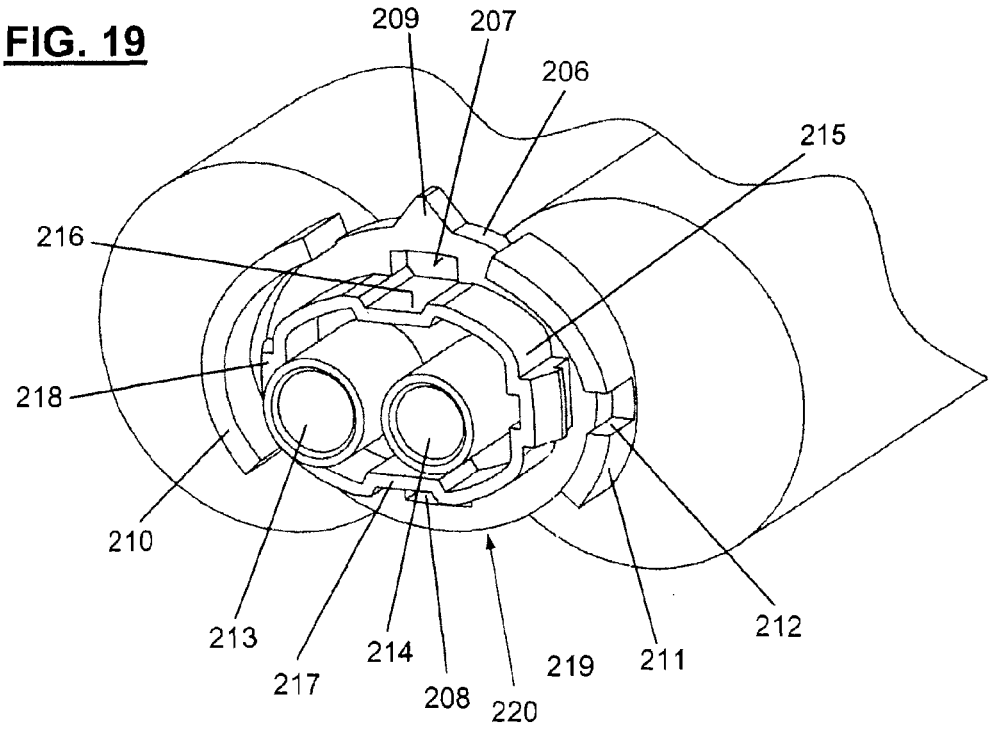

Fastening area 220 of the cartridge, see also FIG. 19, comprises a flange 206 having respective snap openings 207, 208 in the boundary area of the two containers and a visual coding member 209 in the form of a nose. On its circumference, in the area of the two front faces of the containers, flange 206 has two coding rims 210, 211, coding rim 211 having a coding gap 212.

The two outlets 213 and 214 are surrounded by a crown 215. The two outlets may have different diameters as in the present exemplary embodiment or equal diameters, outlet 214 having a smaller diameter than outlet 213. Near snap openings 207 and 208, crown 215 has respective recesses 216, 217. In contrast to the previously described exemplary embodiments according to FIGS. 1 to 17, the snap noses are not provided on the outlets but on crown 215, snap noses 218, 219 being arranged in the area of the connecting line of the two outlets or cartridge centers, respectively, see particularly FIG. 19.

Figure 20:
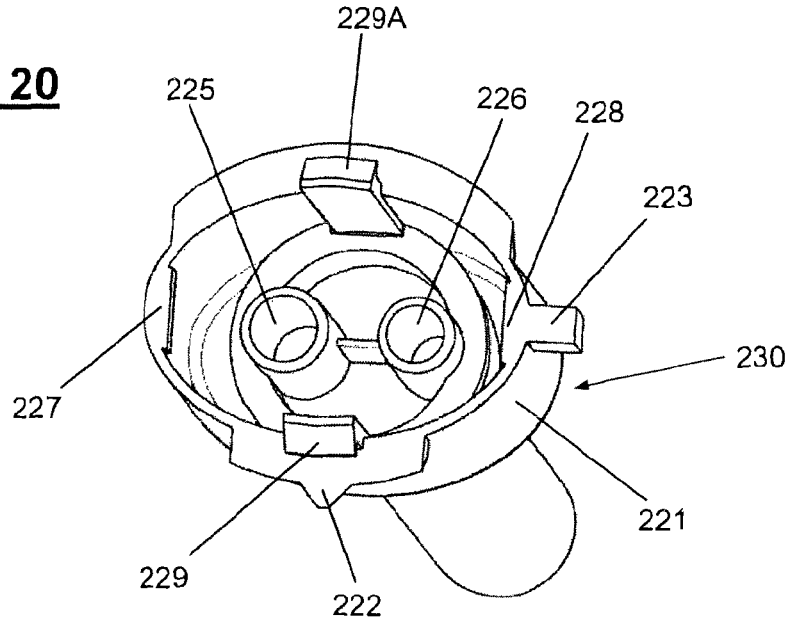

Fastening area 230 of mixer 204 is designed correspondingly. Housing 221 of the fastening area of the mixer is provided with the external coding means, namely visual coding nose 222, coding cam 223 that fits into coding gap 212 on the cartridge, and a coding segment 224 that fits between the coding rims on the mixer. In FIG. 20, the interior elements of the mixer are depicted, i.e. the two inlets 225 and 226, the inlets having different diameters in accordance with the outlets or alternatively equal diameters. The mixer housing further comprises two snap openings 227 and 228 for receiving snap noses 218 and 219 on the cartridge.

In contrast to the preceding exemplary embodiments, the fastening area of the mixer comprises two additional retaining elements, the two snap ledges 229 and 229A, whose noses are adapted to engage behind snap openings 207 and 208 on the cartridge flange in order to provide a higher retaining force than in the previous exemplary embodiments.

Figure 21:
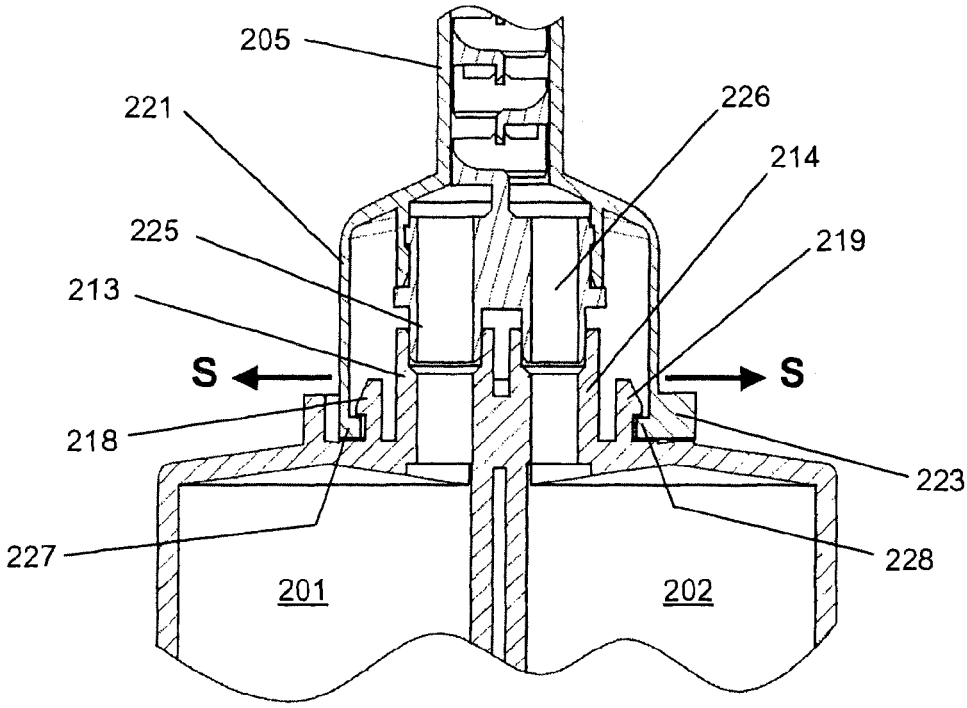
Figure 22:
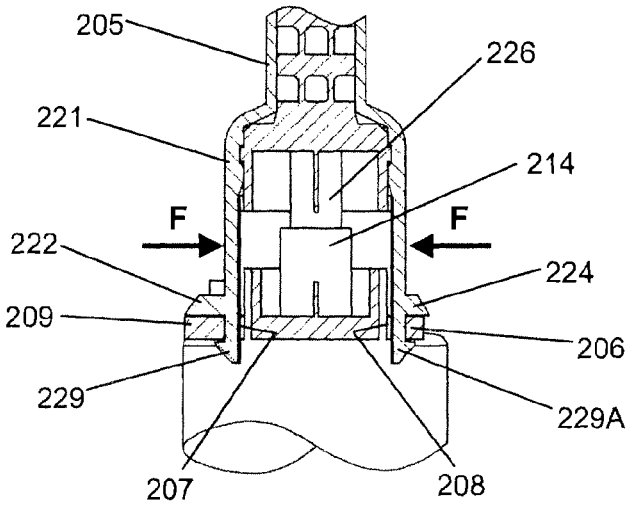

The sectional views of FIGS. 21 and 22 illustrate the forces F that are applied to the fastening area of the mixer during the withdrawal of the mixer, thereby compressing the latter in the direction of the two F arrows and expanding it in the direction of the two arrows S. In this manner, the positions of these FIGS. 21 and 22 are reached, FIG. 21 showing a sectional view according to plane XXI-XXI and FIG. 22 a sectional view according to plane XXII-XXII in FIG. 18 and both sectional views illustrating that, according to FIG. 21, during the compression of the fastening area of the mixer, snap openings 227 and 228 of the mixer are moved in the directions of arrows S and disengaged from snap noses 218 and 219 on the cartridge, and simultaneously, according to FIG. 22, during the compression of the fastening area of the mixer in the direction of arrows F, the noses of snap ledges 229 and 229A are disengaged from snap openings 207 and 208 on the cartridge. As a result of these two movements, the mixer can be withdrawn.

Figure 23:
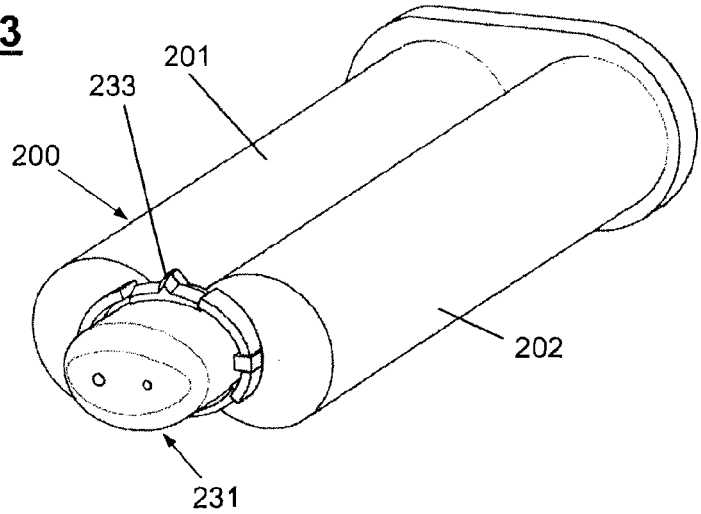
Figure 24:
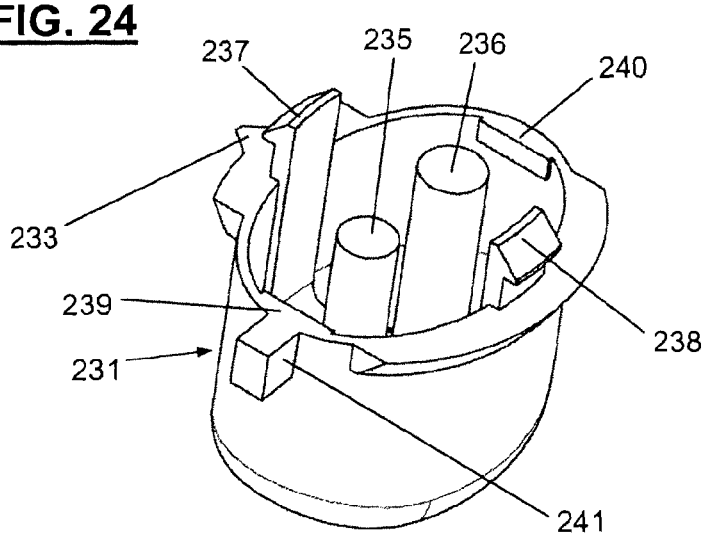

FIGS. 23 and 24 show closure cap 231, which corresponds to closure cap 2 of the first exemplary embodiment. In FIG. 23, cartridge 200 and a closure cap 231 are shown in a perspective view. In FIG. 24, analogously to the mixer housing, cap housing 232 has a visual coding member 233 and a coding segment 234. In the interior of the cap housing, two plugs 235 and 236 are arranged which may have different diameters in accordance with the outlets of the cartridge, or alternatively equal diameters. In analogy to the mixer, the cap has two snap ledges 237 and 238 and, rotated by 90°, two snap openings 239, 240. The process of snapping in and withdrawing the cap is the same as with the mixer.

The last exemplary embodiment according to FIGS. 18 to 24 has been disclosed in the form of a double cartridge that is injection-molded in one piece. It is also possible to design such a cartridge analogously to the separate syringes according to FIGS. 16 and 17 with separate containers 163 and 164, fastening area 220 of the cartridge and of accessories 230 according to FIGS. 18 to 24 being transferable to the separate containers and container receptacles 154, respectively, in full analogy to the previous examples according to FIGS. 16, 17.

The invention claimed is:

1. A dispensing assembly comprising:

a syringe or cartridge including at least one container and a first fastening area including a first retaining portion, wherein the first retaining portion includes at least a first pair of retaining elements provided in mutually opposite side areas of the first fastening area; and at least one accessory including a housing that includes a second fastening area and mutually opposite, compressible housing portion, wherein the second fastening area includes a second retaining portion that includes at least a second pair of retaining elements cooperating with the first pair of retaining elements, wherein the housing portions are offset along a circumference of the housing in relation to the second pair of retaining elements, and wherein the first retaining portion and the second retaining portion are configured such that the at least one accessory is configured to slip onto the syringe or cartridge and be removed from the syringe or cartridge without a twisting motion by applying pressure to the compressible housing portions, thereby releasing the second pair of retaining elements from the first pair of retaining elements.

2. A dispensing assembly according to claim 1, wherein the syringe or cartridge further includes two outlets, and wherein the first pair of retaining elements is arranged in a region of a center line that connects the two outlets thereof.

3. A dispensing assembly according to claim 1, wherein the at least one accessory further includes an open end, and wherein the first fastening area includes snap noses behind which the open end of the at least one accessory is engageable and disengageable by compressing the second fastening area.

4. A dispensing assembly according to claim 1, wherein the first fastening area includes two saddle ridges with saddle portions, wherein one of the saddle portions includes an end ridge that is wider than the saddle ridge, and wherein the second fastening area of the at least one accessory includes two corresponding coding slots that allow the at least one accessory to be slipped-on in only one particular orientation.

5. A dispensing assembly according to claim 1, wherein the first fastening area and the second fastening area each include an aligning nose.

6. A dispensing assembly according to claim 1, wherein the first fastening area includes clamping guides onto which corresponding clamping portions on the second fastening area of the at least one accessory are configured to be clamped.

7. A dispensing assembly according to claim 1, wherein the first retaining portion further includes a third pair of retaining elements on mutually opposite sides of the first fastening area, and wherein the third pair of retaining elements cooperates with a corresponding fourth pair of retaining elements on the compressible housing portions of the at least one accessory.

8. A dispensing assembly according to claim 7, wherein one pair of the third and fourth pair of retaining elements includes a pair of snap noses or snap ledges, and wherein the other pair of the third and fourth pair of retaining elements includes a pair of snap openings.

9. A dispensing assembly according to claim 7, wherein the syringe or cartridge comprises two containers, and wherein the third pair of retaining elements is located in an area of a boundary between the containers.

10. A dispensing assembly according to claim 1, wherein the at least one accessory is an intermediate piece that is configured to attach to the syringe or cartridge.

11. A dispensing assembly according to claim 1, wherein the housing of the at least one accessory is deformable in the second fastening area.

12. A dispensing assembly according to claim 11, wherein the housing includes a cross section that is essentially oval or circular in the second fastening area.

13. A dispensing assembly according to claim 1, wherein the first fastening area and the second fastening area include coding elements in order to ensure an unequivocal orientation of the at least one accessory when the at least one accessory is attached.

14. A dispensing assembly according to claim 1, wherein the syringe or cartridge has at least one outlet and wherein the at least one accessory is outlets of the containers are each sealable by a closure cap for the at least one outlet, the closure cap having an open compressible circumferential collar, wherein the circumferential collar has a pair of recessed portions forming the second pair of retaining elements, wherein the syringe or cartridge has a pair of retaining noses in the region of the at least one outlet, the retaining noses forming the first pair of retaining elements, and wherein the recessed portions are adapted to be engaged behind the retaining noses.

15. A dispensing assembly according to claim 1, wherein the second retaining portion is arranged to move radially outwards when the compressible housing portions of the at least one accessory are pressed radially inwards.

16. A dispensing assembly according to claim 1, wherein the second retaining elements include snap openings, wherein the first retaining elements include snap noses configured to snap into said snap openings, and wherein the snap openings are unlockable from the snap noses by compressing the compressible housing portions of the at least one accessory.

17. A dispensing assembly according to claim 1, wherein the compressible housing portions are offset in relation to the second pair of retaining elements along the circumferential direction by about 90 degrees.

18. A dispensing assembly comprising:

a double syringe or double cartridge including two containers connected by a connecting element, each container including a container outlet; and at least one accessory, wherein the connecting element includes a unit consisting of at least a container receptacle, a support wall, and a retaining flange, the support wall having at least one recess for receiving at least one of the container outlets, and the container receptacle having a guiding sleeve, wherein the double syringe or double cartridge further includes an outlet end configured as a first fastening area for attaching a mixer or the at least one accessory, and wherein the at least one accessory is configured to slip onto the syringe or cartridge and be removed from the syringe or cartridge without a twisting motion.

19. A dispensing assembly according to claim 18, wherein the unit includes a holder having two container receptacles, a support wall, and a one-piece retaining flange, the support wall having recesses for receiving the container outlets and the container receptacles having respective guiding sleeves.

20. A dispensing assembly according to claim 18, wherein the unit includes one of said containers, one container receptacle, a support wall, and a retaining flange, the support wall having a recess for receiving a container outlet, and the container receptacle having a guiding sleeve.

21. A dispensing assembly comprising:

a double syringe or double cartridge including two containers connected by a connecting element, each container including a support wall portion, a container outlet arranged on said support wall portion, and a container inlet side having a retaining flange portion, wherein the connecting element is arranged on the support wall portions and on the retaining flange portions, the support wall portions in an assembled state forming a common support wall, and the retaining flange portions in an assembled state forming a common retaining flange; and at least one accessory, wherein the double syringe or double cartridge further includes an outlet end configured as a first fastening area for attaching a mixer or the at least one accessory, and wherein the at least one accessory is configured to slip onto the syringe or cartridge and be removed from the syringe or cartridge without a twisting motion.

22. A dispensing assembly according to claim 21, wherein the connecting element includes at least one respective snap opening in the support wall portion and in the retaining flange portion of one of the containers and at least one respective connecting pin on the support wall and retaining flange portions of the other container.

23. A dispensing assembly comprising:

a syringe or cartridge having at least one container;

an adapter or intermediate part attached to the syringe or cartridge, the adapter or intermediate part including a first fastening area including a first retaining portion, wherein the first retaining portion includes at least a first pair of retaining elements provided in mutually opposite side areas of the first fastening area; and at least one accessory including a housing that includes a second fastening area and mutually opposite, compressible housing portion, wherein the second fastening area includes a second retaining portion that includes at least a second pair of retaining elements cooperating with the first pair of retaining elements, wherein the housing portions are offset along a circumference of the housing in relation to the second pair of retaining elements, and wherein the first retaining portion and the second retaining portion are configured such that the at least one accessory is configured to slip onto the adapter or intermediate part and be removed from the adapter or intermediate part without a twisting motion by applying pressure to the compressible housing portions, thereby releasing the second pair of retaining elements from the first pair of retaining elements.

24. A dispensing assembly according to claim 23, wherein the syringe or cartridge includes an outlet flange that is provided with coded bayonet slots, and wherein the adapter or intermediate part includes a coded bayonet cams and coding segments on one side and a coded fastening area on the other side.

25. A dispensing assembly according to claim 23, wherein the at least one accessory includes an open end, and wherein the first fastening area includes snap noses behind which the open end of the at least one accessory is engageable and disengageable by compressing the second fastening area.

26. A dispensing assembly according to claim 23, wherein the first retaining portion further includes a third pair of retaining elements on mutually opposite sides of the first fastening area, and wherein the third pair of retaining elements cooperates with a corresponding fourth pair of retaining elements on the compressible housing portions of the at least one accessory.

27. A dispensing assembly according to claim 26, wherein one pair of the third and fourth pair of retaining elements includes a pair of snap noses or snap ledges, and wherein the other pair of the third and fourth pair of retaining elements includes a pair of snap openings.

28. A dispensing assembly according to claim 23, wherein the housing of the at least one accessory is deformable in the second fastening area.

29. A dispensing assembly according to claim 28, wherein the housing includes a cross section that is essentially oval or circular in the second fastening area.

30. A dispensing assembly according to claim 23, wherein the first fastening area and the second fastening area include coding elements in order to ensure an unequivocal orientation of the at least one accessory when the at least one accessory is attached.

31. A dispensing assembly according to claim 23, wherein the second retaining portion is arranged to move radially outwards when the compressible housing portions of the at least one accessory are pressed radially inwards.

32. A dispensing assembly according to claim 23, wherein the second retaining elements include snap openings, wherein the first retaining elements include snap noses configured to snap into said snap openings, and wherein the snap openings are unlockable from the snap noses by compressing the compressible housing portions of the at least one accessory.

33. A dispensing assembly according to claim 23, wherein the compressible housing portions are offset in relation to the second pair of retaining elements along the circumferential direction by about 90 degrees.

* * * * *